United States Patent [19]

Chikaraishi

[11] 4,441,276

[45] Apr. 10, 1984

[54] WINDOW REGULATING DEVICE FOR A WINDOW GLASS OF A VEHICLE DOOR OR THE LIKE

[75] Inventor: Takayo Chikaraishi, Tokyo, Japan

[73] Assignee: Nissan Motor Co., Ltd., Yokohama, Japan

[21] Appl. No.: 283,804

[22] Filed: Jul. 16, 1981

[30] Foreign Application Priority Data

Jul. 26, 1980 [JP] Japan ..... 55-102663
Aug. 1, 1980 [JP] Japan ..... 55-106164

[51] Int. Cl.[3] ..... E05F 11/48
[52] U.S. Cl. ..... 49/352; 49/360
[58] Field of Search ..... 49/352, 360

[56] References Cited

U.S. PATENT DOCUMENTS

| | | | |
|---|---|---|---|
| 3,281,991 | 11/1966 | Colell | 49/352 |
| 3,427,748 | 2/1969 | Marr . | |
| 3,640,022 | 2/1972 | Kouth et al. | 49/352 X |
| 3,831,320 | 8/1974 | Dauernheim et al. | 49/352 |
| 3,930,339 | 1/1976 | Jander | 49/352 |
| 4,199,899 | 4/1980 | Muhling et al. | 49/352 |

FOREIGN PATENT DOCUMENTS

| | | | |
|---|---|---|---|
| 1555632 | 8/1970 | Fed. Rep. of Germany . | |
| 2037244 | 2/1972 | Fed. Rep. of Germany . | |
| 7420048 | 10/1974 | Fed. Rep. of Germany . | |
| 2900499 | 7/1980 | Fed. Rep. of Germany . | |
| 1448795 | 9/1976 | United Kingdom | 49/352 |

*Primary Examiner*—Philip C. Kannan
*Attorney, Agent, or Firm*—Lane, Aitken & Kananen

[57] ABSTRACT

A stationary guide rail has "V" shaped sides which partially enclose a slotted tube and which have a section which endows on the rail a high "second moment of inertia". A slide member has a pair of arms which embrace the external surfaces of the "V" shaped sides and an extension which passes through the slot in the tube in which an axially movable cable is disposed. The extension has a loop at the end thereof which tightly grips the cable. A handle is connected to a gear wheel meshing with a helical ridge formed on the cable so that winding of the handle very smoothly raises and lowers the window glass.

7 Claims, 16 Drawing Figures

WINDOW REGULATING DEVICE FOR A WINDOW GLASS OF A VEHICLE DOOR OR THE LIKE

BACKGROUND OF THE INVENTION

1. Field of the Invention

The present invention relates generally to window regulators and more specifically to an improved cable type window regulator.

2. Brief Description of the Prior Art

In a known arrangement shown in FIG. 1, a window glass 1 has been raised and lowered using a crank arm 2 driven by a suitable manually operated mechanism 3. This arrangement, while being sturdy has suffered from the drawback of being heavy and increasing the thickness of the door 4 (especially that portion indicated in FIG. 2 by "L") in which it is disposed due to the inherent bulk of the winder and arm mechanism. In order to solve both of the weight and the thickness problems it has been subsequently proposed to use a cable type regulator 5 such as shown in FIG. 3. However, this arrangement has suffered from a notable lack of stability and a resulting very jerky operation. Accordingly, various stabilizing measures such as proposed in Japanese Patent Application "Tokkosho 50-17733" have been employed. These stablizing arrangements are shown in FIGS. 6 to 9. In each of these arrangements, a stationary guide rail 6 is fixedly secured to a slotted tube 7 in which a cable 8 having a helical ridge is slidably disposed. A movable bracket 9 is fixedly connected to the cable 8 by an extension thereof which passes through the slot in the tube 7. Blocks 10 are mounted on the bracket 9 and located so that slits 11 formed therein slidably receive the edges of the guide rail. The bracket 9 is also fixedly connected to the window glass so that upon the cable being moved within the tube via rotation of a handle 12, which drives a gear wheel 13 arranged to mesh with the helical ridge of on the cable 8 (see FIG. 4), the window glass is accordingly raised or lowered along a predetermined path 14 (shown in phantom in FIG. 5).

However, these arrangements have still been unable to provide the desired degree of rigidity and resulting smooth jerk-free sliding stability while simultaneously inducing a further problem that the mass production of the regulator having these kind of stabilizers is difficult. That is to say, in these previously proposed arrangements, as the guide rails 6 have been formed from relatively thin and accordingly flexible sheet steel or the like (to minimize weight), the blocks 10 which slide on the rails are required to be formed with correspondingly narrow slits 11. These narrow slits apart from being difficult to cut within the required close tolerances so as to fit rattle free on the guide rail or rails, also require that during assembly, the blocks in which they are formed be very accurately located so as to ensure proper alignment of the slits with the portions of the guide rails which are received therein. All of this complicates production increasing the overall cost of the final product while still not providing satisfactory operational characteristics.

SUMMARY OF THE INVENTION

The present invention features a cable type regulator in which a stationary guide rail member is formed with a pair of mirror image "V" shaped arms which extend to partly surround the tube in which the cable is slidably disposed. A slide member is received on the guide rail and formed with a pair of mirror image arms having a configuration adapted to slidingly embrace the outer surfaces of the guide rail sides. With this arrangement, the arms of the slide member can be thick and accordingly very rigid while the guide rail due to its configuration has a cross section having a high "second moment of inertia of area" which, in combination with the thick arms of the slider, provides an excellent degree of smoothness when raising or lowering the window glass.

Thus, with the invention, the cable type regulator mechanism is improved to the point where, due to its inherent compactness and lightness, it is preferably used in doors or the like wherein a thickness dimension reduction is sought. This is especially the case in sliding doors which have a guide rail or track arrangement associated therewith which curves inwardly into the vehicle and accordingly consumes a notable amount of cabin space. Thus, with the invention, this kind of door may be rendered thinner and lighter while simultaneously reducing the dimensions of the guide rail arrangement and thus the amount of cabin space taken up by same. The thickness of this kind of door may be particularly reduced by disposing the guide rail and slider outboard of the path along which the window moves and if so desired, arranging the shaft of the regulator mechanism handle to cross this path at a location where it also acts as a limit to limit the degree by which the window may be lowered.

BRIEF DESCRIPTION OF THE DRAWINGS

The features and advantages of the arrangement of the present invention will become more clearly appreciated from the following description taken in conjunction with the accompanying drawings in which like reference numerals denote corresponding elements, and in which.

DETAILED DESCRIPTION OF THE PREFERRED EMBODIMENTS

Figure 1:
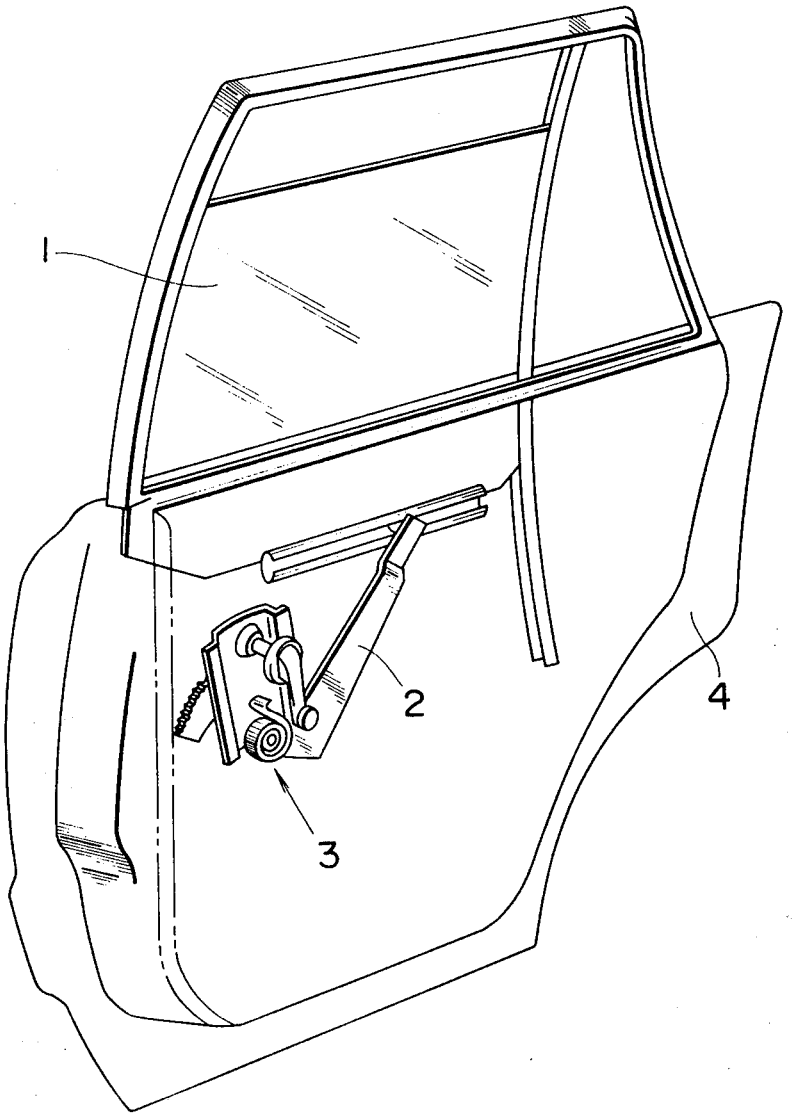
FIG. 1 (PRIOR ART)
FIG. 1 is a perspective view of a prior art "lever" type window regulator.
Figure 2:
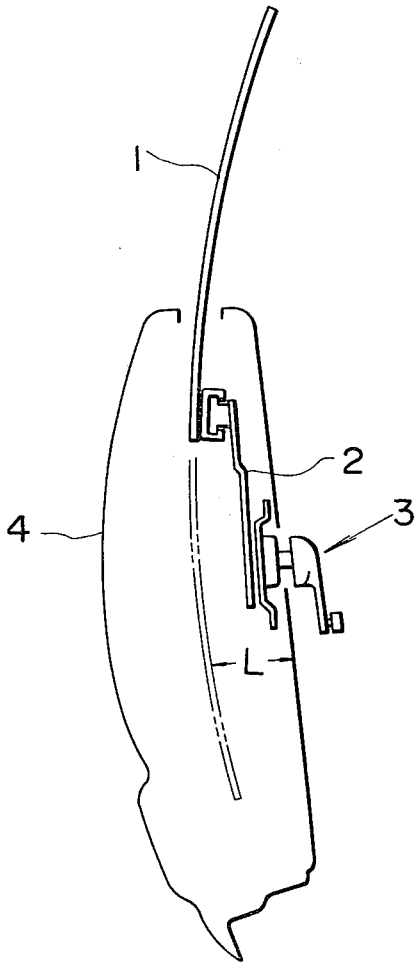
FIG. 2 (PRIOR ART)
FIG. 2 is a schematic side elevational view of the arrangement of FIG. 1.
Figure 3:
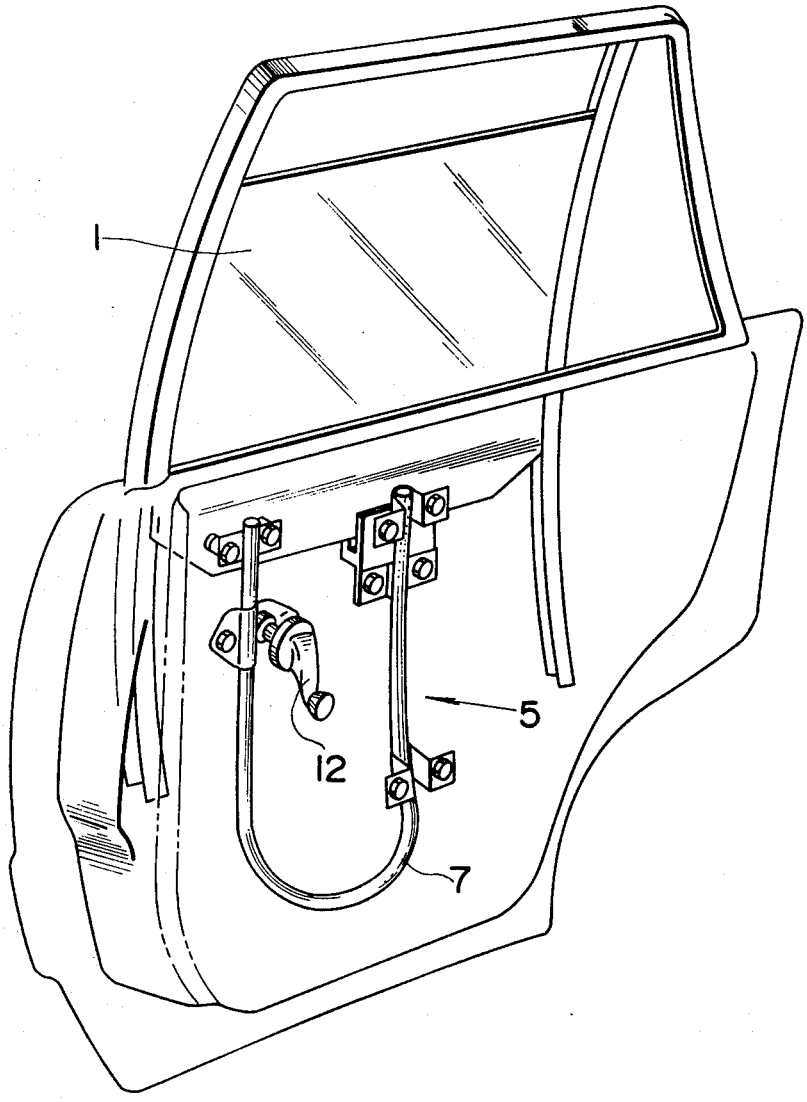
FIG. 3 (PRIOR ART)
FIG. 3 is a perspective view of a prior art "cable" type window regulator.
Figure 4:
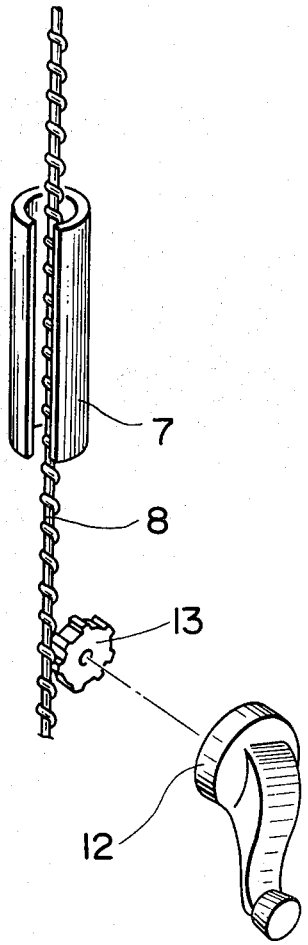
FIG. 4 (PRIOR ART)
FIG. 4 is a schematic perspective view of a part of the arrangement shown in FIG. 3.
Figure 5:
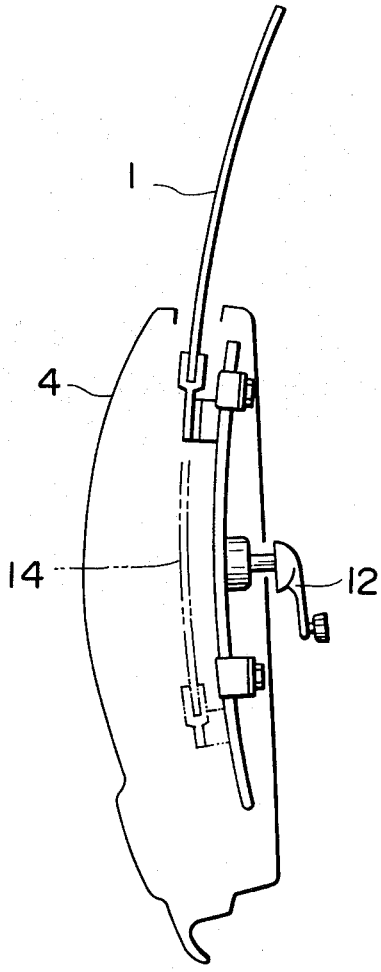
FIG. 5 (PRIOR ART)
FIG. 5 is a side elevation of the arrangement shown in FIG. 3.
Figure 6:
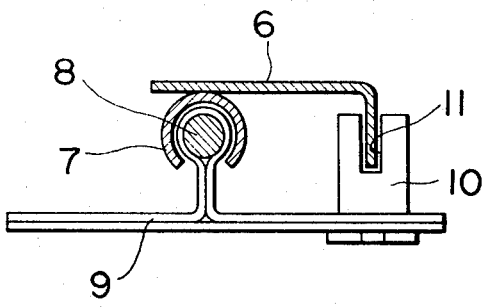
FIG. 6 (PRIOR ART)
FIGS. 6 to 9 show various prior art stabilizing arrangements used in connection with the arrangement shown in FIG. 3.
Figure 7:
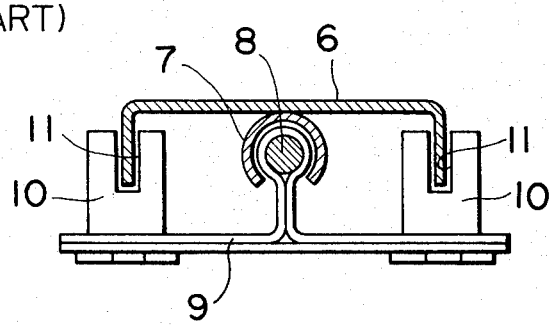
FIG. 7 (PRIOR ART)
Figure 8:
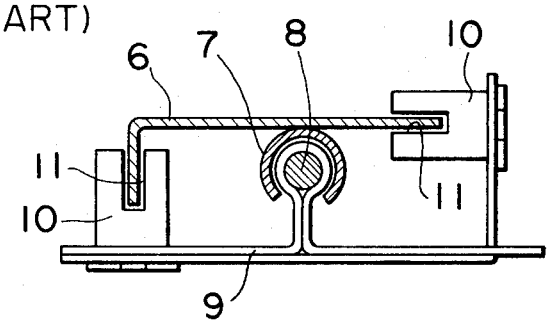
FIG. 8 (PRIOR ART)
Figure 9:
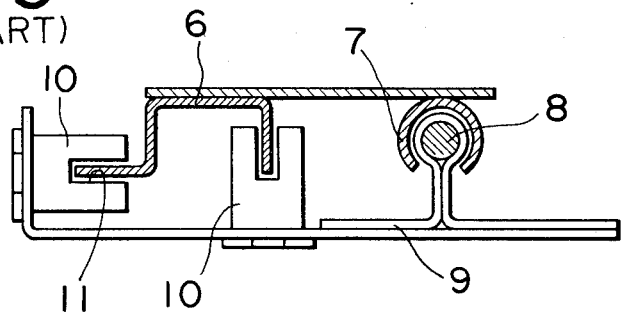
FIG. 9 (PRIOR ART)

Turning now to the drawings and more specifically to FIGS. 10 to 14, a preferred embodiment of the present invention is shown. In these figures, a stabilizing arrangement which characterizes the invention is generally denoted by the numeral 20. This arrangement comprises a stationary guide rail 22 which has a pair of "V" shaped sides 24 which tend to enclose a slotted tube 7 disposed immediately adjacent thereto. At the uppermost end of the guide rail, a bracket 26 is provided for attaching the rail to the door proper.

Slidably disposed on the guide rail is a slider or follower generally denoted by 28. This slider includes a bracket 30 formed with an extension 32 which extends through the slot 34 of the tube 7. The extension has a loop 35 at the end which securely grips the cable 8 to provide a secure connection between the bracket and the cable. Fixed to the back of the bracket 30 is a main body 36 of the slider 28. This body is, in this case, made of a suitable plastic and formed with a pair of arms 38 which pass through apertures 40 formed in the bracket 30 and which extend to grip the "V" shaped sides 24 of the guide rail 22. The inboard sides of the arms 38 have acutely angled surfaces 42 which, as shown, are adapted to seat on the outer surfaces of the guide rail sides 24 and thus "embrace" the guide rail as a whole. To further increase the rigidity of the arms 38, ribs 39 are provided to reinforce same.

A bracket 44 is fixed to the window glass via a suitable technique and formed with a pair of depending connection fingers 46. Bolts 48 are disposed through coaxial holes 50 formed in the bracket 30 and main body 36 and threadedly engaged in the threaded bores 52 formed in boss-like extensions on the connection fingers 46. With this arrangement, the slider 28 is fixedly interconnected between the window glass 1 and the cable 8.

Figure 13:
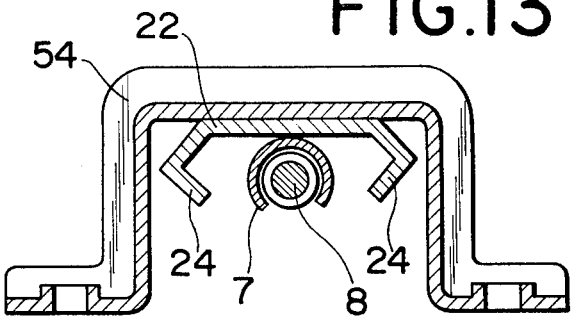
FIG. 13 is a sectional view taken along section line B—B of FIG. 10.
Figure 14:
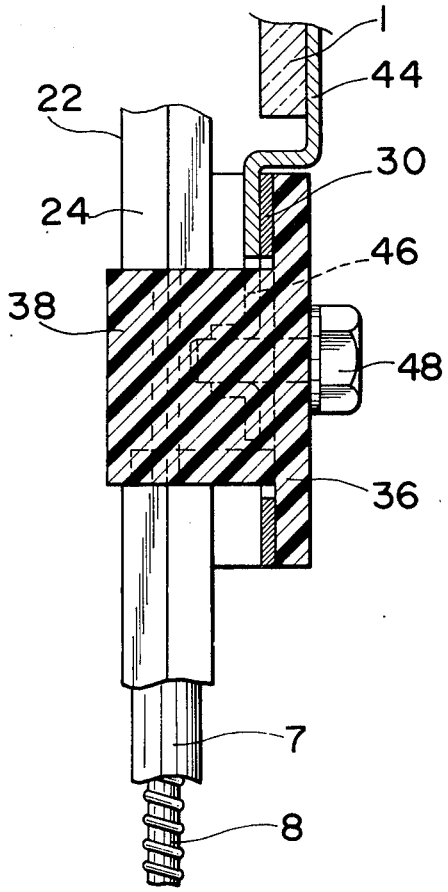
FIG. 14 is a sectional view taken along section line C—C of FIG. 12.

A stop bracket 54 serves to connect the lower end of the guide rail 22 to the door and act as a limit for defining the maximum downward travel of the window away from its closed position. This bracket, as shown in FIG. 13, has a generally "U" shaped configuration which extends on either side of the guide rail 22. With this arrangement, the lower edge of the bracket 30 and the main body 36 will seat on the upper edge of the bracket 54 when the window glass is lowered sufficiently. Alternately, a sliding stop or limit 55 (shown in phantom) which can be secured in any desired position via a grub screw or the like may be provided on the guide rail.

Figure 10:
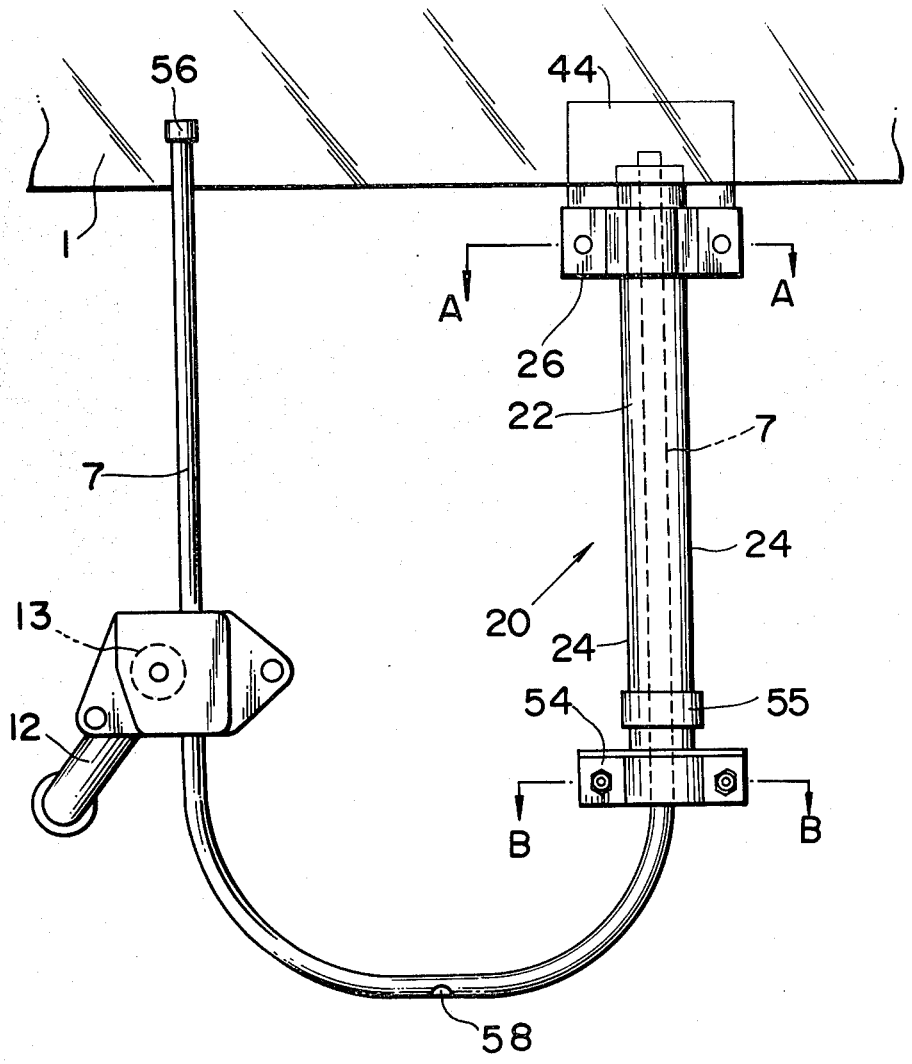
FIG. 10 is a front elevation of a window regulating arrangement according to a preferred embodiment of the present invention.
Figure 11:
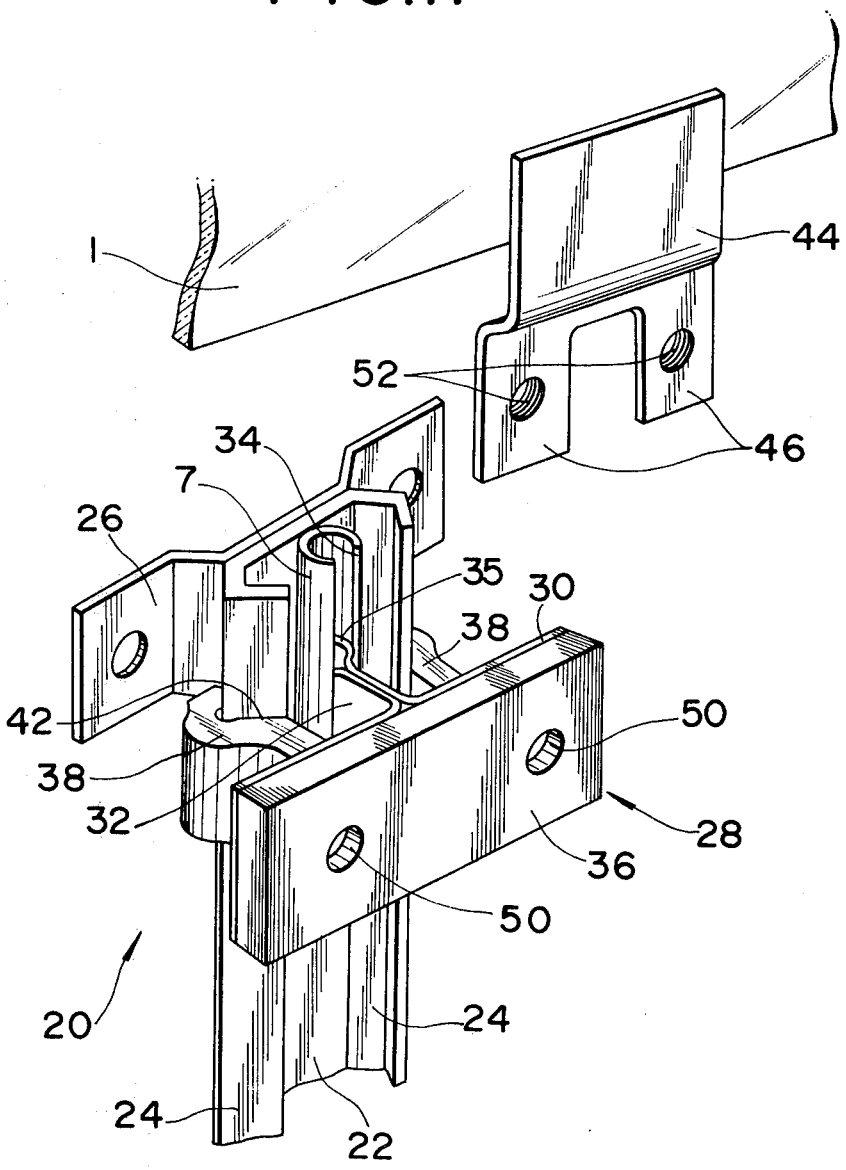
FIG. 11 is a perspective partially exploded view of a part of the preferred embodiment of the present invention wherein, in this figure, some of the elements have been omitted for clarity.
Figure 12:
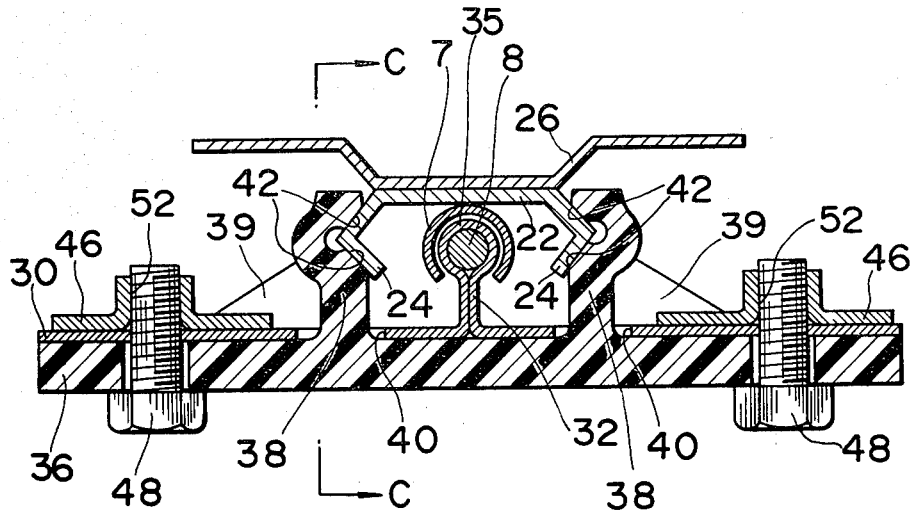
FIG. 12 is a sectional view taken along section line A—A of FIG. 10.

FIG. 10 shows the tube 7 and cable 8 disposed within the door in a generally "U" shaped configuration so that the two ends thereof are oriented upwardly. With this arrangement, as the seal between window glass and the aperture in the door through which it passes, cannot be perfectly sealed against the entry of foreign matter, it is preferable to provide a cap 56 on one or both ends of the tube 74 in order to minimize the amount of water or the like that might tend to enter the tube. It will be understood that the slot 34 formed in the tube 7 need only extend from the stop bracket 54 upwardly and, as such, a cap on the end of the tube located above the handle 12 will tend to almost perfectly close same. However, due to the existence of the slot 34, some water or the like may find its way into the interior of the tube 7 so that a drain hole 58 may be advantageously formed at the lowermost level of the tube 7 for allowing any water accumulated within the tube 7 to escape and subsequently be discharged through a suitable drain hole in the bottom of the door. The cap (or caps 56) is preferably made of a resilient elastomer or the like so that in the event of the free end or ends of the tube flexing under severe vehicle vibration, the cap will serve to soften any impacts on the structural members of the door and thus suppress any tendency for rattling noise to be produced.

Figure 15:
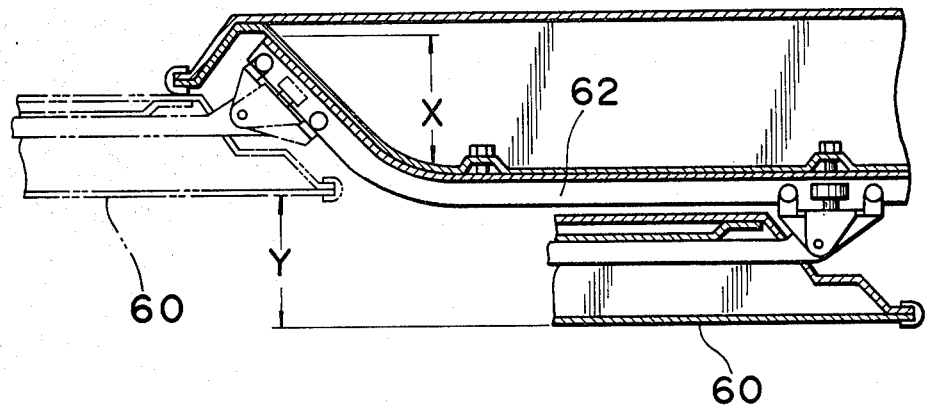
FIG. 15 is a sectional plan view of a sliding vehicle door.

FIG. 15 shows a sliding door 60 which runs a track or guide rail 62. The track 62 is at the end portion thereof, curved inwardly into the vehicle interior by a distance "X" as shown. To allow for the complete closure or the door, shown in phantom, the track must extend inwardly a little further than the innermost level of the door to allow for the bogie-like arrangement which runs on the track to assume the desired position. Accordingly, the thicker the door the further the track must curve into the vehicle interior or cabin. Further, the thicker the door the further the door will project outboard of the vehicle (viz., by a distance "Y" in the open position thereof (shown in solid line). Thus, by reducing the thickness of the door, both the weight of the door and the amount of space consumed by the track arrangement will be reduced.

Figure 16:
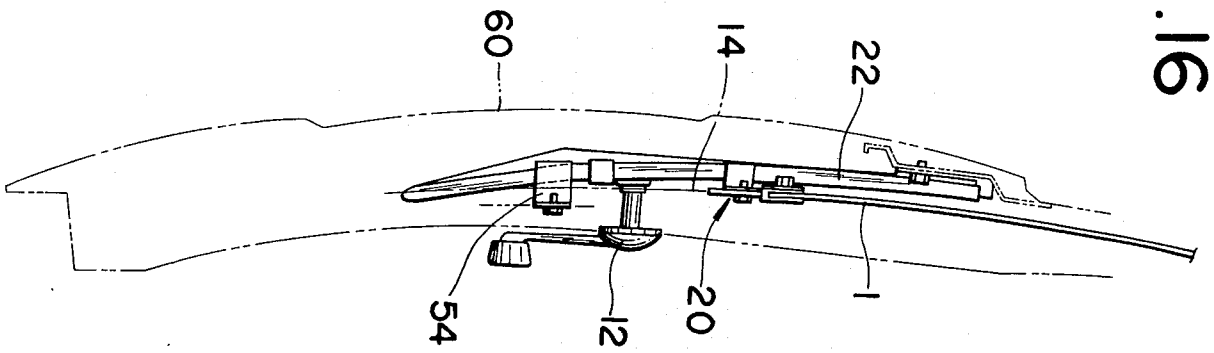
FIG. 16 is a side elevation showing the present invention applied to a sliding door of the nature shown in FIG. 15.

FIG. 16 shows the invention as applied to such a sliding door for reducing the thickness thereof. In this arrangement, the guide rail 22 is disposed on the outboard side of the window path 14 to utilize the otherwise wasted space on this side of said path.

With this cable arrangement of the invention, it is of course possible to locate the handle 12 of the manual winder mechanism 3 in any one of a number of locations without interfering with the movement of the window glass; however, as it is often desired to limit the degree by which a window in a sliding door can be opened, i.e. to prevent children from putting their head or appendages out of the window in a hazardous manner, it is preferred in this arrangement to locate the handle 12 and associated shaft which extends between same and the gear wheel 13, to cross the path 14 of the window at a position to block the movement of the window beyond a predetermined point. This is of course highly advantageous as it allows the use of the same components as used in a normal hinging door (or one wherein a limit is not required), without the need of modifying any of the "standard" components. Hence mass production of both the various types of doors as well as the window regulator of the invention is facilitated.

What is claimed is:

1. In a vehicle door having a window glass, a window regulator mechanism for raising and lowering said window glass along a path from a predetermined position within said door comprising:

an elongate tube located on the outboard side of said path;

an elongate cable slidingly disposed within said tube;

a manually operated mechanism, operatively connected to said cable for moving said cable axially within said tube, including a handle having a shaft arranged to extend across the path of said window to limit the movement of the window away from said predetermined position, said shaft extending from the inboard side of said door toward the outboard side thereof;

a stationary guide rail disposed adjacent said tube on the outboard side of said path, said guide rail having a pair of acutely bent sides which extend on either side of said tube so as to partly enclose same; and a slide member slidably received on said guide rail, said slide member having a pair of arms which embrace the sides of said guide rail, said slide member being attached to said window glass and to said cable for movement therewith.

2. In a vehicle door having a window glass, a window regulator mechanism for raising and lowering said window glass from a predetermined position within said door comprising:

an elongate tube;

an elongte cable slidingly disposed within said tube;

a manually operated mechanism operatively connected to said cable for moving said cable axially within said tube;

a stationary guide rail disposed adjacent said tube, said guide rail having a pair of acutely bent essentially "V" shaped sides which extend on either side of said tube so as to partly enclose same; and a slide member slidably received on said guide rail, said slide member having a pair of arms in which essentially "V" shaped grooves are formed, said grooves having acutely angled surfaces which seat on said "V" shaped sides and which embrace said essentially "V" shaped sides of said guide rail, said slide member being attached to said window glass and to said cable for movement therewith.

3. A window regulator as claimed in either claim 1 or 2, wherein said slide member includes a bracket, said bracket having an extension formed with a loop at the free end thereof, said loop being disposed tightly about said cable to provide a secure connection therebetween.

4. A window regulator as claimed in claim 1 or 2, wherein said cable has a helical ridge formed along the length thereof and wherein said manually operated mechanism includes a handle which drives a gear wheel meshing with said helical ridge.

5. A window regulator as claimed in either claim 1 or 2, further comprising a cap disposed on an open end of said tube for closing same and preventing the entry of foreign matter.

6. A window regulator as claimed in claim 3, wherein said slider further includes a main body attached to the back of said bracket, said main body being formed with said arms, which arms project through apertures formed in said bracket.

7. A window regulator as claimed in either claim 1 or 2 wherein said tube is disposed in said door in a generally "U" shaped configuration and which has a drain hole formed in the lowermost portion thereof.

* * * * *